United States Patent [19]

Platt

[11] 4,258,561

[45] Mar. 31, 1981

[54] COILING MACHINE

[75] Inventor: Stephen A. Platt, Grand Haven, Mich.

[73] Assignee: S. A. Platt, Inc., Grand Haven, Mich.

[21] Appl. No.: 40,556

[22] Filed: May 21, 1979

[51] Int. Cl.[3] ..... B21F 3/02; B21F 3/04

[52] U.S. Cl. ..... 72/142; 72/145; 242/7.01

[58] Field of Search ..... 242/7.11, 7.01, 7.06, 242/7.07, 7.09; 72/142, 145, 135; 140/71.5, 92.2, 103

[56] References Cited

U.S. PATENT DOCUMENTS

| | | | |
|---|---|---|---|
| 2,227,602 | 1/1941 | Platt | 72/145 |
| 2,388,401 | 11/1945 | Freundlich | 72/145 |
| 2,909,209 | 10/1959 | Ciccone et al. | 72/145 X |
| 3,082,810 | 3/1963 | Platt | 72/145 |
| 3,401,557 | 9/1968 | Platt | 72/142 X |

*Primary Examiner*—Stanley N. Gilreath

*Attorney, Agent, or Firm*—Price, Heneveld, Huizenga & Cooper

[57] ABSTRACT

Coiling machine with identical diameter arbors each end of spindle, contacted by a pair of identical diameter rings on each arbor, transmitting their picked up power to associated cushioned work rings with complete speed synchronism and unvarying coiling pressure on the wire.

7 Claims, 6 Drawing Figures

COILING MACHINE

BACKGROUND OF THE INVENTION

This invention relates to wire coiling machines.

The demands required of coiling machines during the period from the 1940's to the present have increased markedly. For example, the coiling of resistance wire for sophisticated instrumentation has become extremely precise and exacting. At times, the wire involved is only 0.003 inches in diameter, i.e. about 0.0005 inches more than human hair. With wire this fine, the drive torque on the coiling rolls has a drastic effect on the operation. Yet, no machines in existence, including those of my previous patents, are of a design such that there is no drive torque to influence coiling pressure on the delicate wire.

Coiling machines of the 1940's, see e.g. my U.S. Pat. No. 2,227,602 employed broadfaced rubber rolls which picked up power directly from the spinning arbor and had to be angled to coil at all. So, the machine was built, of necessity, with compound angling sectors to the outside of each of the two rolls. It was not possible with such a construction to "hang" the coiling rolls. Thus, even their weight imparted pressure to the wire. And, transfer of coiling power from the rear of the machine caused torque imbalance between the two coiling rolls at the front of the machine. Actually when coiling the larger diameter wire then involved, this was not a significant problem. Subsequent coiling machines brought power from the rear of the machine by speed reduction and flexible cables so that the coiling rolls could be angled and have heavy coiling power. See e.g. my U.S. Pat. No. 3,082,810. Since surface speed synchronization of spinning arbor and back-up rings was only approximate on such machines, the two cooperative back-up rings were designed never to touch the spinning arbor. Hence, drive torque added to coiling pressure of one of the coiling rolls, i.e. the rear roll, and substracted from the other cooperative coiling roll, i.e. the front roll.

As a result of my more recent efforts, there is disclosed in copending application Ser. No. 7,158 now U.S. Pat. No. 4,208,896, special steel back-up rings which pick up their coiling power by steel-to-steel contact with the spinning arbor itself to coil delicate wire. It will be realized that very small forces are involved with spinning operations on such delicate wire. At times, the spinning arbors themselves are only 0.015 inches in diameter, so that the pick-up power of the two steel back-up rings biased against such small spinning arbors is minute, as are all the forces involved.

To coil such fine wire sizes as presently necessary, and do so accurately and efficiently, it has been found important to obtain completely equal coiling pressure from both coiling rolls. It is also important that there be resilience of cushioning between the forming roll portion of the coiling roll, and the wire being coiled around the arbor. And if fast production is to be maintained, there must be excellent heat dissipation while coiling.

Development of a machine to satisfy these exacting requirements has resulted in a novel assembly which not only meets these requirements but surprisingly enough, is actually simpler in construction than prior machines.

SUMMARY OF THE INVENTION

An object of this invention therefore is to provide a wire coiling machine for coiling delicate wire, usually resistance wire, with equal coiling pressure at both coiling rolls, plus resilience of cushioning of each forming roll portion of each coiling roll on the wire being coiled around the tiny arbor.

The machine has a double-ended spindle with collets or chucks at both ends retaining identical diameter arbors. Identical diameter drive pick-up rings on the rear end of the machine add their power to like identical rings on the front coiling end of the machine, without torque forces adding or subtracting from coiling pressure. The rolls and their parallel shafts are "hung" from above, on the centerline of their mass, so that no hanging weight of parts enters into the coiling pressures. The coiling force brought forward is at a one-to-one speed ratio with the front rolls. The horizontal pivot shafts have adjustable horizontally axial movement to position coiling rolls. The pick-up rings front and rear of the machine are spring biased to contact with the identical spinning arbors.

Thus, the coiling machine has identical diameter arbors at each end of the spindle, contacted by a pair of identical diameter rings on each arbor, transmitting their picked up power to associated cushioned work rings with complete speed synchronism and unvarying coiling pressure on the wire.

DESCRIPTION OF THE PREFERRED EMBODIMENT

Figure 1:
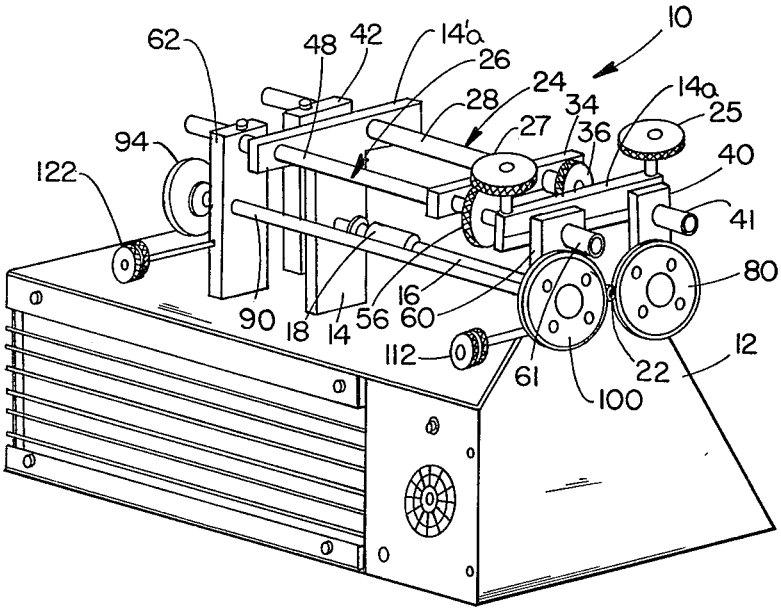
FIG. 1 is a perspective view of the novel coiling machine.
Figure 2:
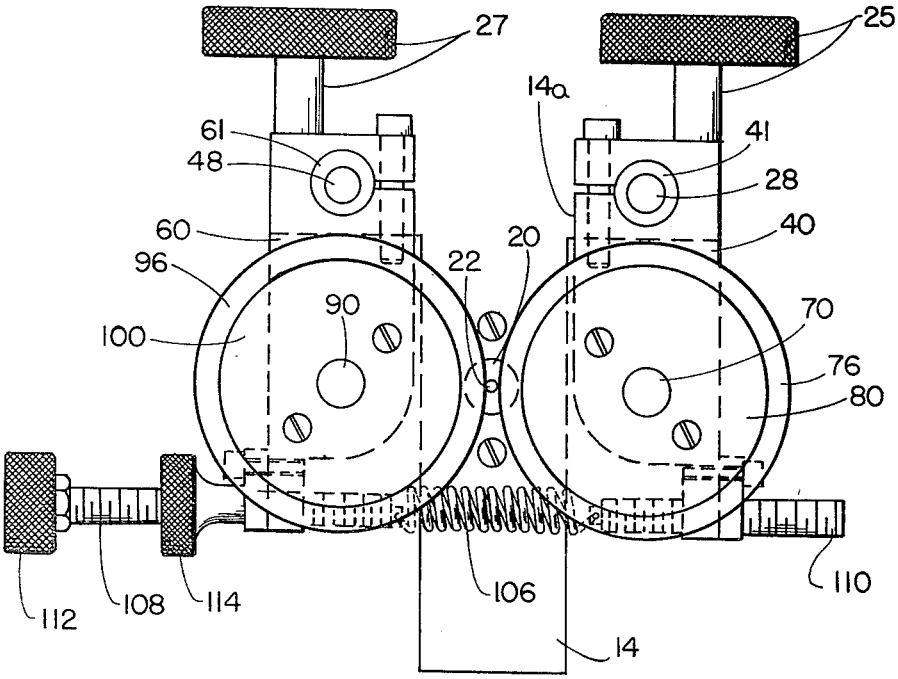
FIG. 2 is a front elevational view of portions of the apparatus in FIG. 1.
Figure 3:
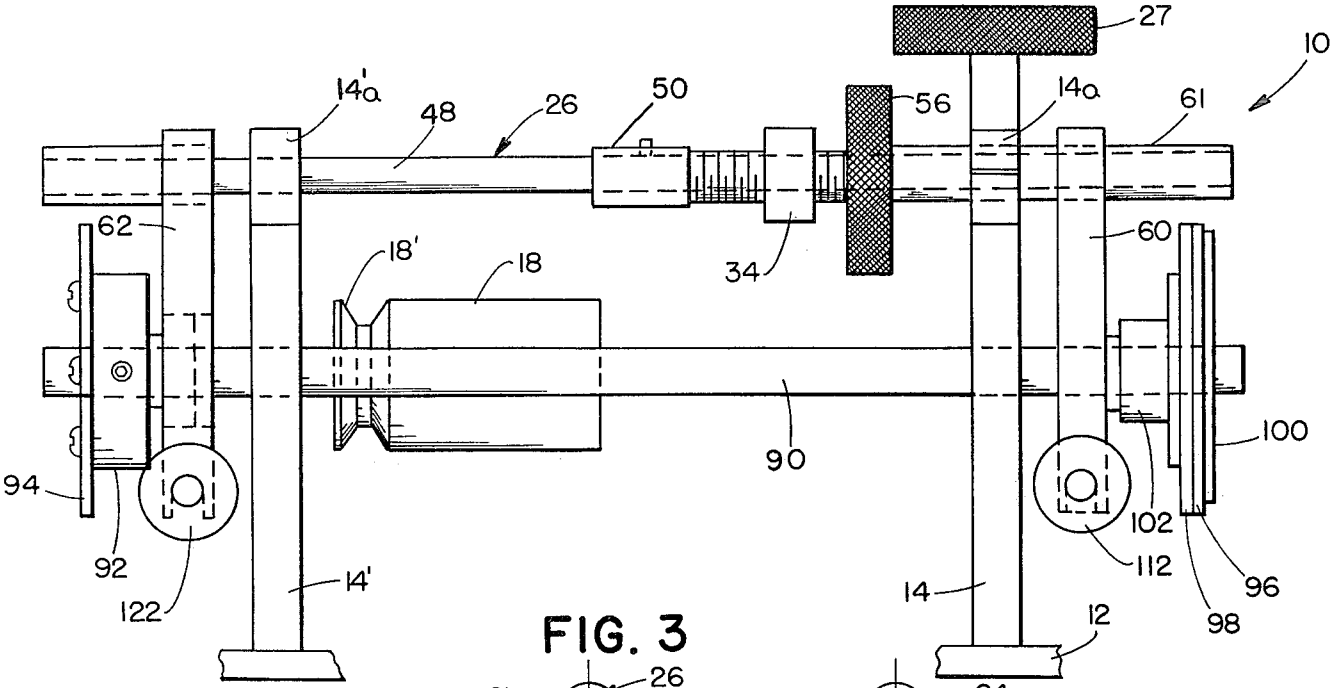
FIG. 3 is a side elevational view of the apparatus in FIG. 2.

The wire coiling machine assembly 10 includes a base 12 with a pair of trunnions, namely front trunnion 14 and rear trunnion 14' upstanding from the base. These trunnions are basically T-shaped in configuration, each having a cross member, **14*a* and 14'*a* respectively. Supported by and rotatably mounted in the vertical legs of these trunnions is a rotary spindle 16, oriented horizontally and extending fore and aft, including forwardly beyond the front trunnion and rearwardly beyond the rear trunnion. On spindle 16 is a drive collar 18 with a belt pulley portion 18' to enable the spindle to be powered by a rotational power source such as an electrical motor (not shown). At the forward end of spindle 16 is a front collet or chuck 20 which retains a small diameter cylindrical front arbor 22. At the rear end of spindle 16 is a rear collet or chuck 20' identical to collet 20, retaining a small cylindrical rear arbor 22' identical to arbor 22**.

Supported by the upper cross legs of the trunnions, and more particularly offset laterally on both sides from the vertical central legs of the trunnions, is a pair of pivot support bar subassemblies 24 and 26 which are basically identical to each other and parallel to each other and the spindle. Cross member **14*a* of trunnion 14 has split ends and adjacent openings to receive the front members of these support bar subassemblies. Each split end includes a tightening stud with knob, 25 and 27** respectively, threadably engaged with the split ends to control the ease of pivoting of these subassemblies on the front trunnion. Subassembly 24 includes a rear fixed support bar 28 mounted to the cross member 14'a of trunnion 14', a fixed collar 30 on the forward end of bar 28, and a front, axially adjustable, pivot support bar 32 which is rotatable relative to the cross leg 14a of the front trunnion 14. This front bar 32 is threadably engaged with the collar 30 and also is threadably engaged with a double collar bar 34 extending transversely of the assembly. An adjustment wheel 36 is affixed to front bar 32 to enable this bar to be rotated for horizontally axially adjusting the position of the bar and the wire coiling components (to be described) mounted thereon. Toward the forward end of subassembly 24 is a suspended hanger 40 which preferably includes a fixed sleeve portion 41 to receive the forward end of rod 32. At the rear end of rod 28, i.e. of assembly 24 is a rear hanger 42 which preferably includes a sleeve 43 receiving the rear end portion of bar 28.

On the opposite side of the assembly 10 is the pivotal bar subassembly 26, parallel to subassembly 24 and identical therewith. Thus, a rear bar 48 extends through the cross member 14'a of trunnion 14', and has a suspended hanger 62 with an extended collar 63 thereon. Affixed to the forward end of bar 48 is a collar 50 which threadably receives the rear threaded end of forward rod 52 also threadably interconnected with the double collar 34. Rod 52 has a turn wheel 56 affixed thereto for horizontal axial adjustment, and has a suspended hanger 60 on the forward end thereof, such hanger including an affixed extended collar 61 which receives the forward end of rod 52.

Suspended by the pair of hangers 40 and 42, and extending through the lower ends of these hangers, is a drive shaft 70. Attached to the rearward end of drive shaft 70 is a back-up collar 72 to which is affixed a drive ring or pick-up ring 74, the peripheral surface of which engages the rear arbor 22'. Attached to the forward end of shaft 70 is a coiling subassembly which includes a work ring 76, a pick-up ring 78 which serves both as a drive ring and as a back-up ring. Both rings 76 and 78 are retained between a pair of straddling retention collars 80 and 82.

On the opposite side of the assembly is an identical subassembly which includes a drive shaft 90 suspended by the hangers 60 and 62 and extending through the lower portions thereof. On the rear end portion of shaft 90 is a mounting collar 92 and a drive or pick-up ring 94 having its peripheral surface in engagement with the rear arbor 22', opposite drive ring 74. At the forward end of shaft 90, affixed to rotate therewith, is a coiling ring subassembly which includes a work ring 96 and a pick-up ring 98 which serves as a drive ring and a back-up ring. Both rings 96 and 98 are retained between retention collars 100 and 102. During normal operation, the coiling subassemblies on opposite sides of the front arbor 22, are arranged so that the backup and drive rings 78 and 98 engage the periphery of the front arbor 22 on opposite sides thereof, while the work rings 76 and 96 engage the outer surface of the wire coiled around the arbor. The wire turn being formed engages against the axial face of rings 78 and 98, specifically the radially outer portions of the axial faces, so that these rings form a back-up for the coil turn. These work rings 76 and 96 have a resilient outer peripheral portion in accordance with the teachings set forth in my copending application Ser. No. 7,158, filed Jan. 29, 1979 and entitled COILING, incorporated by reference herein.

Also, one of these coiling subassemblies is axially offset relative to the other by an amount which is adjusted to be equal to the diameter of the wire being coiled such that the last turn of the helically coiled wire is given the proper helix angle as it is coiled.

The drive shaft subassemblies, the rear drive or pick-up rings, and the front coiling subassemblies including the work rings and back-up rings, are suspended or hung directly vertically below the pivot shafts. I.e., the axial centerlines of the suspended elements lie in the same vertical planes as the axial centerlines of the pivot shafts. The lateral offset of the drive rings and work rings from the arbor is basically equal to the radial distance from the centerline axis of the suspended elements to the ring peripheries.

The coiling subassemblies containing the drive rings 78 and 98 and work rings 76 and 96 are biased toward each other and toward the front arbor 22 by a biasing coil tension spring arrangement between them. This arrangement includes a tension coil spring 106 (FIG. 4) connected between a pair of threaded rods 108 and 110 which have oppositely oriented threads and which are threadably engaged with the lower end of hangers 40 and 60. Hangers 40 and 60 are pivotally suspended from the forward shafts 32 and 52. The amount of tension put on the spring 106 can be adjusted by rotating threaded rod 108 with a knurled knob 112, after which a lock screw 114 secures the position. This arrangement provids a balanced pressure of both coiling roll subassemblies against the front arbor.

A similar biasing arrangement is employed between the rear hangers 42 and 62. That is, a tension coil spring 116 (FIG. 6) is interconnected between a pair of threaded rods 118 and 120 which have oppositely oriented threads, there being a knurled knob 122 on rod 120 for adjustment of the spring tension, and a lock knob 124 for securement in an adjusted position. These rods are also threadably inter-engaged with the lower ends of the hangers 62 and 42. Hangers 62 and 42 are pivotally suspended from shafts 48 and 28. This arrangement causes a balanced pressure of the two drive rings 74 and 94 against the opposite sides of rear arbor 22'.

Figure 4:
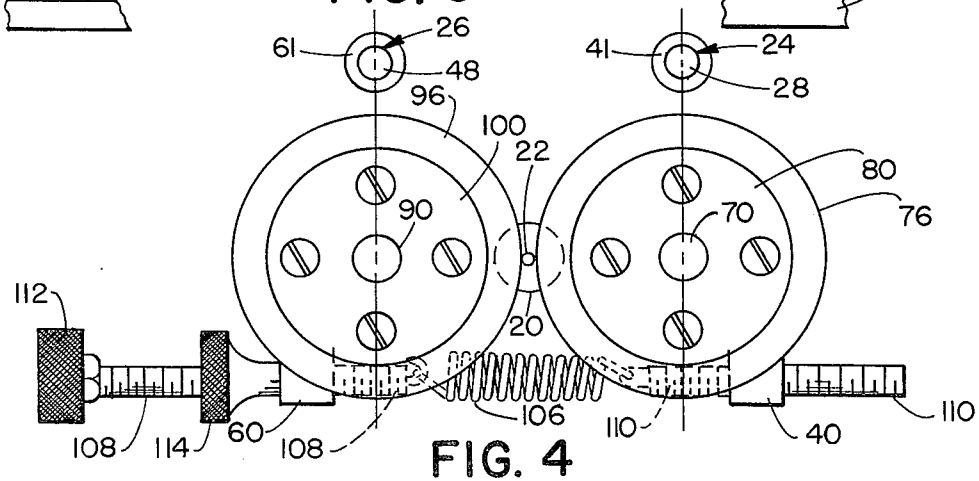
FIG. 4 is a partial front elevational view of the apparatus in FIG. 2.
Figure 5:
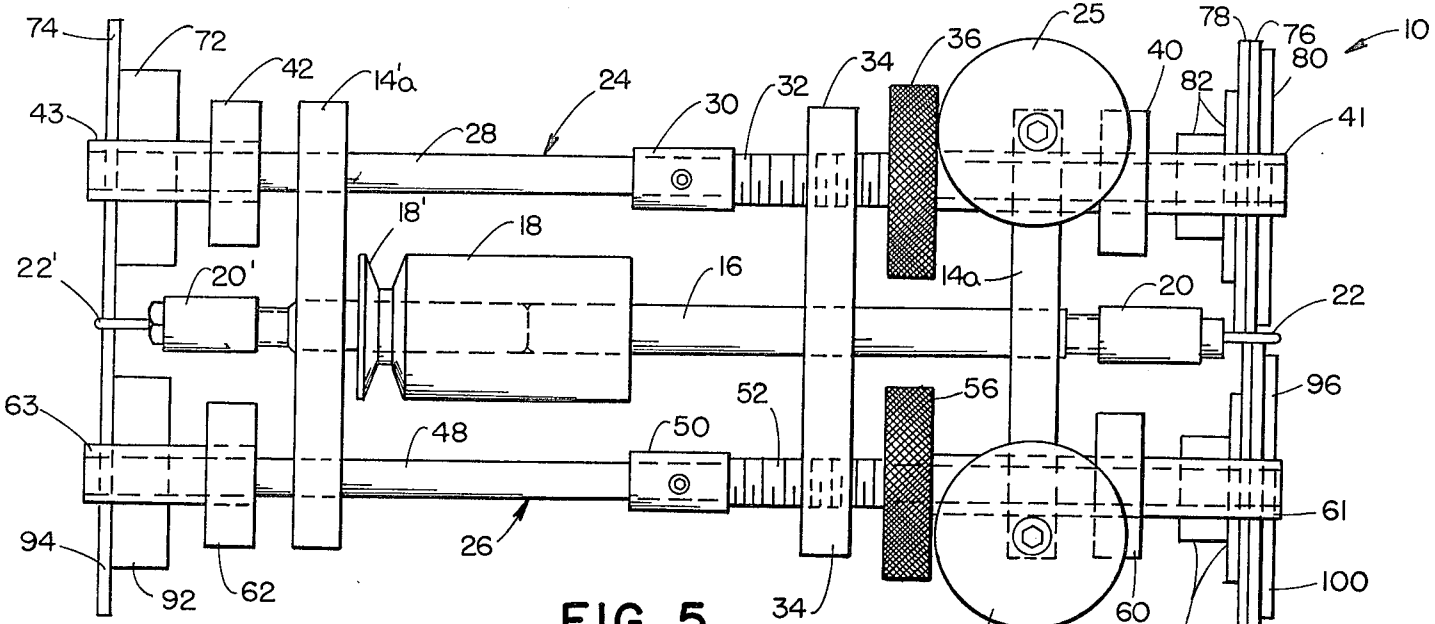
FIG. 5 is a top plan view of the apparatus.
Figure 6:
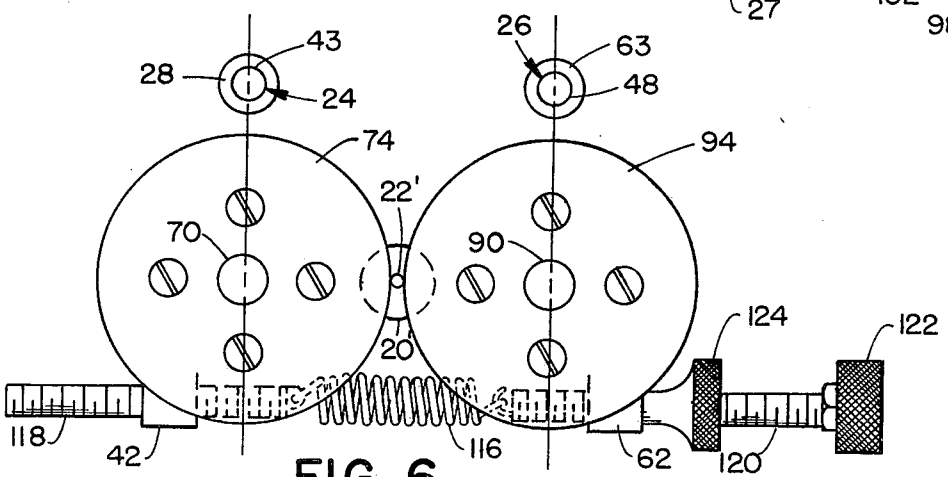
FIG. 6 is a rear elevational view of the apparatus in FIG. 5.

Referring to FIGS. 4 and 6, it will be seen that the axial centerline of the drive shafts 70 and 90 are not only parallel to the pivot bar support subassemblies 24 and 26, but are also directly vertical coplanar therewith so that the center of mass of shafts 70 and 90 and the drive rings work rings, and their attachment collars thereon are hung or suspended directly below the supporting shafts. Therefore no pressure is applied to either side of the arbor or the wire being coiled thereon by the mass of these suspended mechanisms.

In operation, the particular axial position of the two coiling subassemblies, and particularly the work rings 76 and 96 and back-up rings 78 and 98 are adjusted with knurled wheels 56 and 36 so that the offset of one subassembly to the other is equal to the diameter of the wire to be coiled. Power is applied to spindle 16 via collar 18 to cause the identical front and rear arbors 22 and 22' to rotate at equal angular and peripheral velocities. The engagement of the peripheral surface of the steel drive rings or pick-up rings 74 and 94 with rear arbor 22' powers these pick-up rings and the drive shafts 28 and 48 to which they are mounted. This rotational power is advanced directly by these drive shafts to the front work rolls 76 and 96 simultaneously with the power drive picked up by steel pickup or drive rings 78 and 98 to the shafts. Rings 78 and 98, and specifically the radially outer portion of the front axial faces, also serve as back-up rings for the coiling wire.

The wire stock is fed between the outer resilient periphery of work ring 76 and front arbor 22, against the axial face portion of back-up ring 78 that forms a shoulder for the wire, this wire thus being coiled around arbor 22 into engagement with the forwardly offset resilient periphery of work ring 96 and against the front axial face of back-up ring 98 which also serves as a shoulder at the radially outer portion thereof. Continuous revolving of these elements causes the wire to coil and be axially advanced to discharge from the free end of arbor 22. During coiling, the portions of the resilient work rings 76 and 96 engaging the wire are deformed away from arbor 22 an amount about equal to the thickness of the wire, in accordance with the teachings set forth in the above identified copending application Ser. No. 7,158.

The power applied to the work rings and thus to the coiling wire is double because it is obtained from the rear as well as the front of the apparatus with the double arbor arrangement. The direct drive shaft arrangement assures against torque imbalance. Moreover there is no added pressure applied by the work rolls due to the mass of the ring components and shaft subassemblies, because the directly vertically hung arrangement prevents this. The centerline of mass of the subassemblies are vertically below the axes of the pivot shafts.

As a consequence of this combination of features, it has been found that the coiling pressures applied by both sides are equal, balanced and unvarying, achieving high speed accurate coiling of delicate resistance wire, particularly suitable for resistance elements in instrumentation and the like, the wire portions being unaltered in electrical resistivity as a result of the coiling process. The power picked up at the front and rear is transmitted to the work rings with complete speed synchronism as well as unvarying coiling pressure on the wire. Remarkably, in spite of the improved functional characteristics of the apparatus, it is actually simpler in construction than prior units.

The embodiments of the invention in which an exclusive property or privilege is claimed are defined as follows.

1. A wire coiling machine comprising:

a rotary powered spindle having a front end and a rear end;

like front and rear arbors retained at said front and rear ends of said spindle to rotate therewith;

a pair of like drive subassemblies comprising:

a pair of rotary shafts astraddle of and parallel to said spindle, each having a front end adjacent said front arbor and a rear end adjacent said rear arbor;

a pair of like rear drive rings respectively on said rear ends of said shafts, having metal peripheral surfaces engaging opposite sides of said rear arbor;

a pair of like front drive rings respectively on said front ends of said shafts, having metal peripheral surfaces engaging opposite sides of said front arbor;

said shafts, front drive rings and rear drive rings being suspended on axes vertically coplanar with the centerlines of their respective masses;

a pair of work rings respectively on said front ends of said shafts adjacent said pair of front drive rings, positioned to engage coiling wire against said front arbor;

said front drive rings forming an axial shoulder for the wire engaged by said work rings;

said work rings having resilient peripheral wire engaging surfaces; and biasing means between said drive subassemblies for retaining said pairs of front and rear drive rings in engagement with said arbors and retaining said work rings in coiling relation to said front arbor;

whereby said work rings apply coiling pressure to the wire free of torque imbalance pressures and without pressure from the weight of the suspended drive subassemblies.

2. The coiling machine in claim 1 wherein said arbors and said drive rings are sized to effect a one-to-one speed ratio of said rear drive rings relative to said front drive rings.

3. The coiling machine in claim 2 wherein said front drive rolls are of like diameter with said rear drive rolls.

4. The coiling machine in claim 1 wherein said front drive rolls and said work rolls are axially adjustable relative to each other.

5. A wire coiling machine comprising:

a rotary powered spindle having a front end and a rear end;

front and rear coiling arbors retained at said front and rear ends of said spindle to rotate therewith;

a pair of like drive subassemblies comprising:

a pair of rotary shafts astraddle of and parallel to said spindle, each having a front end adjacent said front arbor and a rear end adjacent said rear arbor;

a pair of rear drive rings respectively on said rear ends of said shafts, having metal peripheral surfaces engaging opposite sides of said rear arbor;

a pair of front drive rings respectively on said front ends of said shafts, having metal peripheral surfaces engaging opposite sides of said front arbor;

and a pair of work rings respectively on said front ends of said shafts adjacent said pair of front drive rings, positioned to engage coiling wire against said front arbor.

6. The wire coiling machine in claim 5 wherein said shafts, front drive rings and rear drive rings are suspended on axes vertically coplanar with the centerlines of their respective masses.

7. The wire coiling machine in claim 5 or 6 wherein said arbors are of like diameter and said front drive rolls are of like diameter with said rear drive rolls;

said front drive rings form a shoulder on the axial face thereof for the wire engaged by said work rings;

said work rings have resilient peripheral wire engaging surfaces; and biasing means between said drive subassemblies for retaining said pairs of front and rear drive rings in engagement with said arbors and retaining said work rings in coiling relation to said front arbor.

* * * * *